United States Patent [19]

Cameron

[11] Patent Number: 4,949,769

[45] Date of Patent: Aug. 21, 1990

[54] LOG DELIVERY MECHANISM

[76] Inventor: Robert E. Cameron, P.O. Box 251, Warrenton, Oreg. 97146

[21] Appl. No.: 407,668

[22] Filed: Sep. 15, 1989

[51] Int. Cl.[5] ..... B27B 15/04; B27B 31/00

[52] U.S. Cl. ..... 144/245 A; 83/365; 144/242 D; 144/242 M; 144/378; 144/357; 198/434; 198/394; 414/746.3

[58] Field of Search ..... 414/745.8, 746.3; 198/434, 394; 83/365, 367; 144/242 R, 242 D, 242 E, 242 M, 245 R, 245 A, 357, 377, 378, 245 B

[56] References Cited

U.S. PATENT DOCUMENTS

| | | | |
|---|---|---|---|
| 2,857,941 | 10/1958 | Baker . | |
| 3,736,968 | 6/1973 | Mason | 144/3 R |
| 3,746,065 | 7/1973 | Mason | 144/309 |
| 4,250,937 | 2/1981 | Detjen | 144/376 |
| 4,262,572 | 4/1981 | Flodin | 83/471.2 |
| 4,294,149 | 10/1981 | Olsson | 144/242 R |
| 4,353,276 | 10/1982 | Ackerfeldt | 144/378 |
| 4,378,829 | 4/1983 | Sohn | 144/357 |
| 4,458,567 | 7/1984 | Tuomaala | 83/13 |
| 4,737,031 | 4/1988 | Mahlberg et al. | 356/372 |

*Primary Examiner*—W. Donald Bray
*Attorney, Agent, or Firm*—Delbert J. Barnard

[57] ABSTRACT

A log-positioning conveyor (10) includes a pair of spaced-apart lug-supporting frames (12, 14) and an interconnecting center frame (16). Vertical and horizontal cylinders (42, 44, 46, 48), one of each at each end of the conveyor, are interconnected between end frame members (22, 24) and anchor locations (50, 52, 54, 56). The cylinders (42, 44, 46, 48) are extended and retracted for moving the conveyor vertically and/or horizontally. The conveyor frame (12, 14, 16) is stabilized in position, both endwise and angularly by a stabilizing arm (66). This arm (66) has a universal joint (68) at its inner end connected to an end frame (24) and a universal joint (70) at its outer end connected to an anchoring structure (72). A system of horizontal and vertical light beams (HB, VB) is used to measure each log as it ascends on the conveyor (10) to an uppermost position. After the measured log reaches the uppermost position, the cylinders (42, 44, 46, 48) are extended or retracted, as necessary, in order to position the entire conveyor (10) to in this manner move the log (L) that is at the uppermost position into a desired pick-up position for that particular log (L).

16 Claims, 10 Drawing Sheets

Fig. 6
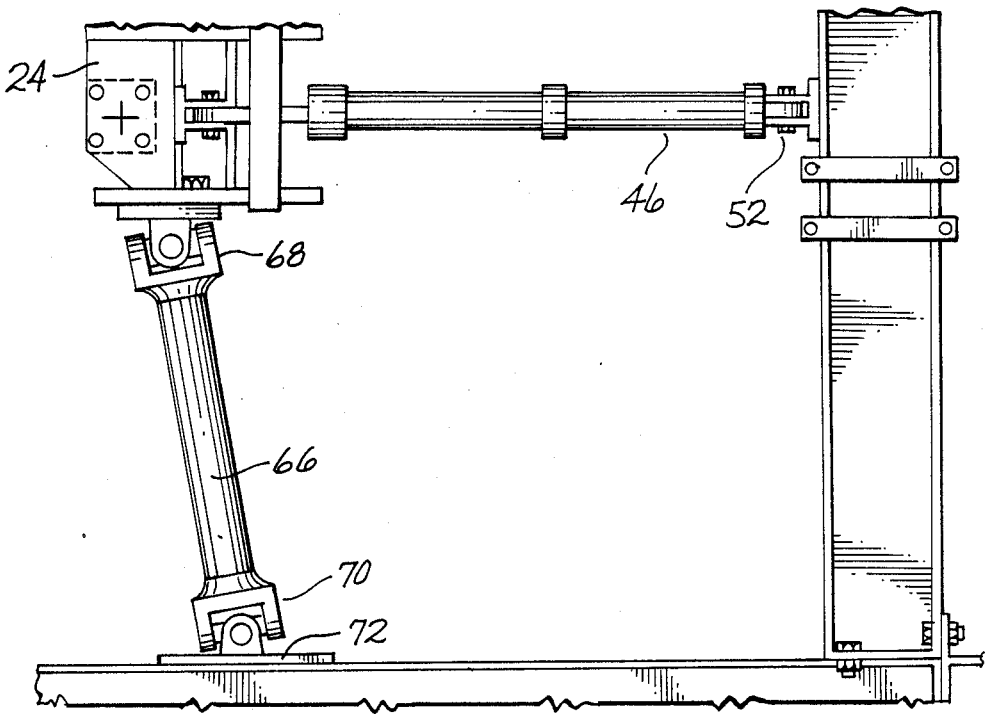
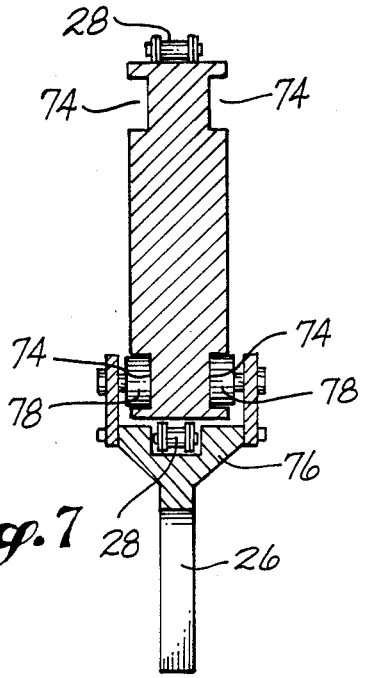
Fig. 7

LOG DELIVERY MECHANISM

TECHNICAL FIELD

This invention relates to mechanisms for delivering logs into a position to be picked up by an end-dogging log carriage, or the like. More particularly, it relates to a log-positioning mechanism which receives logs one at a time, and moves each upwardly into an uppermost position on the mechanism, and measures each log as it moves, and then after each log reaches the uppermost position, moves the mechanism horizontally and/or vertically, in response to a characteristic of the log (e.g. its diameter), for placing each such log into a desirable pick-up position for that particular log.

BACKGROUND ART

An end-dogging log carriage system comprises a carriage having spaced-apart elements termed "end-dogs" between which a log is secured. The dogs are movable between "raised" and "down" positions. The carriage is brought to a pick-up station with the end-dogs raised. Logs are delivered sideways, one at a time, to the pick-up station. The end-dogs are then swung downwardly against the two ends of the log. The end-dogs include teeth which bite into the ends of the log, to secure the log to the carriage. The carriage is then moved along a track to move the log endwise through a cutting station. The cutting station may include one or more band saws, circular saws or chipper heads, etc.

There is a need for a log delivery mechanism which can quickly and simply move logs into a position to be picked up by the end-dogging log carriage. There is particularly a need for such a mechanism which will take into consideration size and shape differences in the logs and, in response to the characteristics of each log, place it into a desirable pick-up position for that particular log. A principal object of the present invention is to provide such a mechanism.

DISCLOSURE OF THE INVENTION

Log-positioning mechanisms of the present invention are basically characterized by an endless conveyor having an endless conveyor path which includes an ascending upper run. A plurality of spaced-apart log-engaging lugs travel the endles conveyor path. A power drive steps the lugs in position about the endless conveyor path. Each step positions a new pair of log-engaging lugs in an uppermost position on the conveyor. In use, logs are delivered in succession onto the upper run, each immediately forwardly of a pair of log-engaging lugs. The log-engaging lugs engage the logs and move then upwardly and forwardly as the log-engaging lugs move. A measurement means is provided for measuring at least a diameter of each log as it travels along the upper run of the conveyor, and producing a measurement signal. A positioning means, responsive to the measurement signal, moves the conveyor horizontally and/or vertically, as necessary, after the measured log reaches the uppermost position on the conveyor. The measurement signal causes the positioning means to move each log into a desirable pick-up position for that particular log.

The measurement means may comprise optical means for measuring both the horizontal and vertical diameters of each log. In preferred form, the optical means comprises a means establishing horizontal and vertical scanning beams through which each log must pass as it moves along the upper run of the conveyor to the uppermost position on the conveyor.

In preferred form, the positioning means comprises horizontal and vertical cylinders interconnected between the conveyor and its support structure. A control means responsive to the measurement signal for each log acts to extend ot retract the cylinders to, in that manner, move the conveyor horizontally and/or vertically for positioning the particular log that is at the uppermost position on the conveyor. In preferred form, the conveyor comprises a frame including a pair of spaced-apart lug-supporting frame members and a center frame extending between and rigidly interconnecting the frame members, so that each frame member is substantially fixed in position relative to the other frame member. The lugs on the frame members are positioned in pairs, so that each log is contacted by a pair of lugs, one on each frame member. One horizontal cylinder and one vertical cylinder is provided at each end of the frame. The horizontal and vertical cylinders are interconnected between end portions of the frame and a support structure spaced from the frame. The vertical cylinders are extended for raising the conveyor relative to a lower support structure, and are retracted for lowering the conveyor relative to such structure. The horizontal cylinders are extended for moving the conveyor away from a support structure spaced horizontally from the conveyor, and are retracted for moving the conveyor towards such support structure. In use, the two vertical cylinders may be moved together or separately. Also, the two horizontal cylinders may be moved together or separately. The amount and direction of movement of each cylinder is determined by a measurement of the log to be positioned by a movement of the conveyor.

According to an aspect of the invention, the conveyor is stabilized by a very simple but effective mechanism. A fixed structure is spaced endwise of one end of the conveyor. A non-rotating shaft is interconnected between this fixed structure and a confronting end portion of the conveyor frame. The non-rotating shaft has a universal joint at each end. The universal joints connect the ends of the shaft to the conveyor frame and the support structure, respectively. The universal joints permit the horizontal and vertical movement of the conveyor frame which is necessary for positioning the logs to be handled by the mechanism, but restrain the frame against movement on the cylinders endwise of the frame, and further restrain the conveyor against angular movement about the longitudinal axis of the frame.

In preferred form, the horizontal and vertical cylinders each comprise a cylinder barrel with a closed end and a rod end, and a piston including a piston head within the barrel and a piston rod extending from the piston head out through the rod end of the cylinder barrel. The closed end of the cylinder barrel and the outer end of the rod are pin-connected to the support structure and conveyor frame, respectively. The rod sides of the piston heads are always connected to hydraulic pressure. The opposite sides of the piston heads are connected to a line which extends from the source of pressure and which includes a three-position valve. In a first position, the valve is blocked. In a second position, pressure is communicated to the base side of the piston head. In the third position, pressure is vented from the base side of the piston head to return. When the valve is positioned to communicate pressure to the base end of the cylinder, the cylinder extends because of the area difference between the two sides of the piston head. Log characteristic data, obtained by the measurement means, is delivered to a programmed computer. The computer uses this and other information for controlling movement of the valves, to either add fluid to or remove fluid from the base ends of the cylinders, as it is necessary to move the conveyor the necessary amount and in the necessary direction. Each cylinder includes a position indicator which develops a signal that is delivered to the computer for always informing the computer of the exact position of the cylinder. The drive for the log-engaging lugs includes a rotary shaft that is stepped in position by a stepping motor. A pulse generator, or an equivalent device, is associated with the shaft, for determining the exact position of the shaft and for sending a signal to the computer to inform it of the exact position of the shaft. This information is used for controlling the stepping of the lugs so that each pair of lugs will always move to a proper uppermost position on the conveyor.

Other objects, advantages and features of the invention are hereinafter described in the detailed description of the best mode of the invention.

BRIEF DESCRIPTION OF THE DRAWINGS FIGURES:

Like reference numerals and letters are used to designate like parts throughout the several views of the drawing, and:

Figure 4:
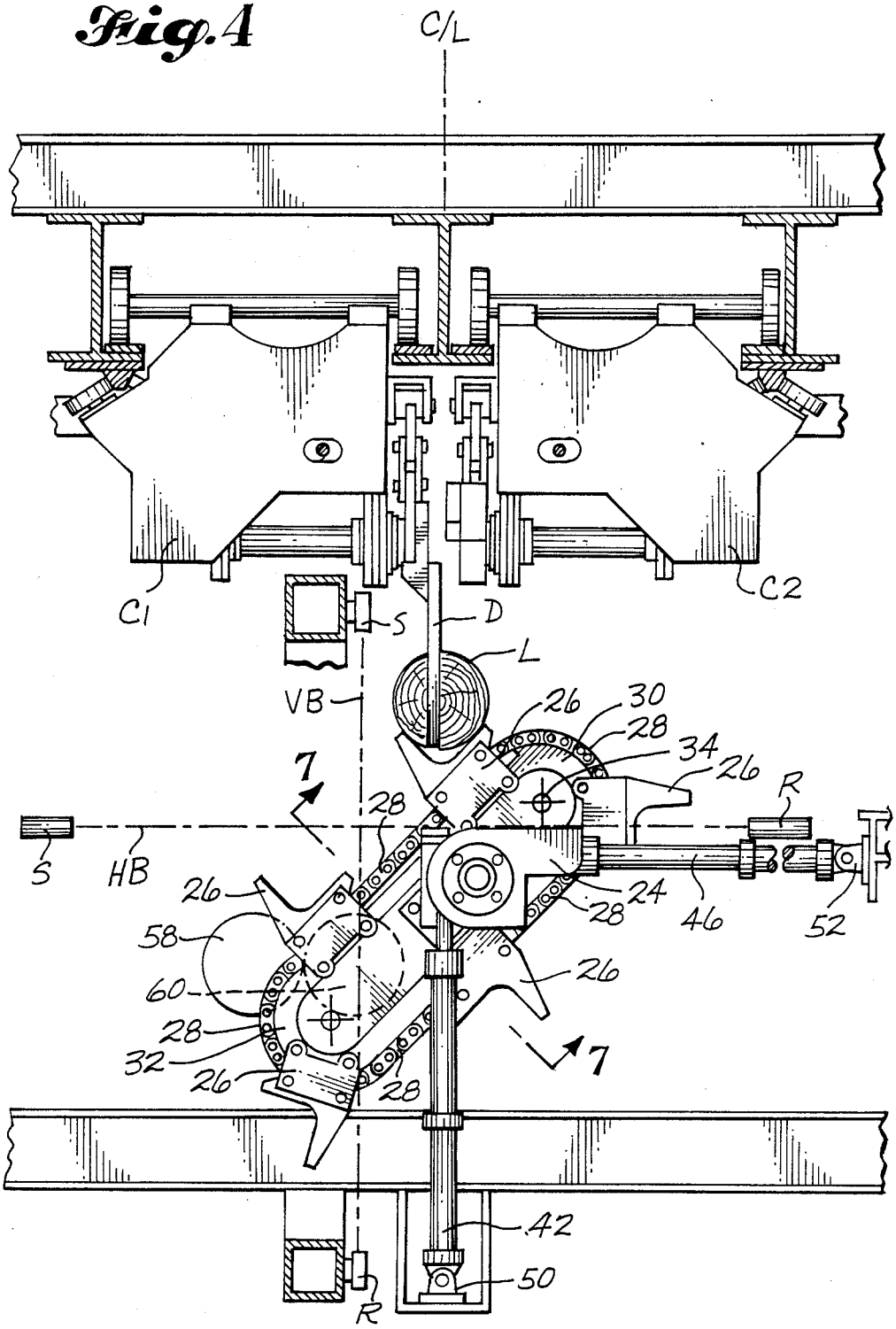
FIG. 4 is a view like FIG. 3, but showing a log at the uppermost position in the process of being picked up by the second carriage.
Figure 8:
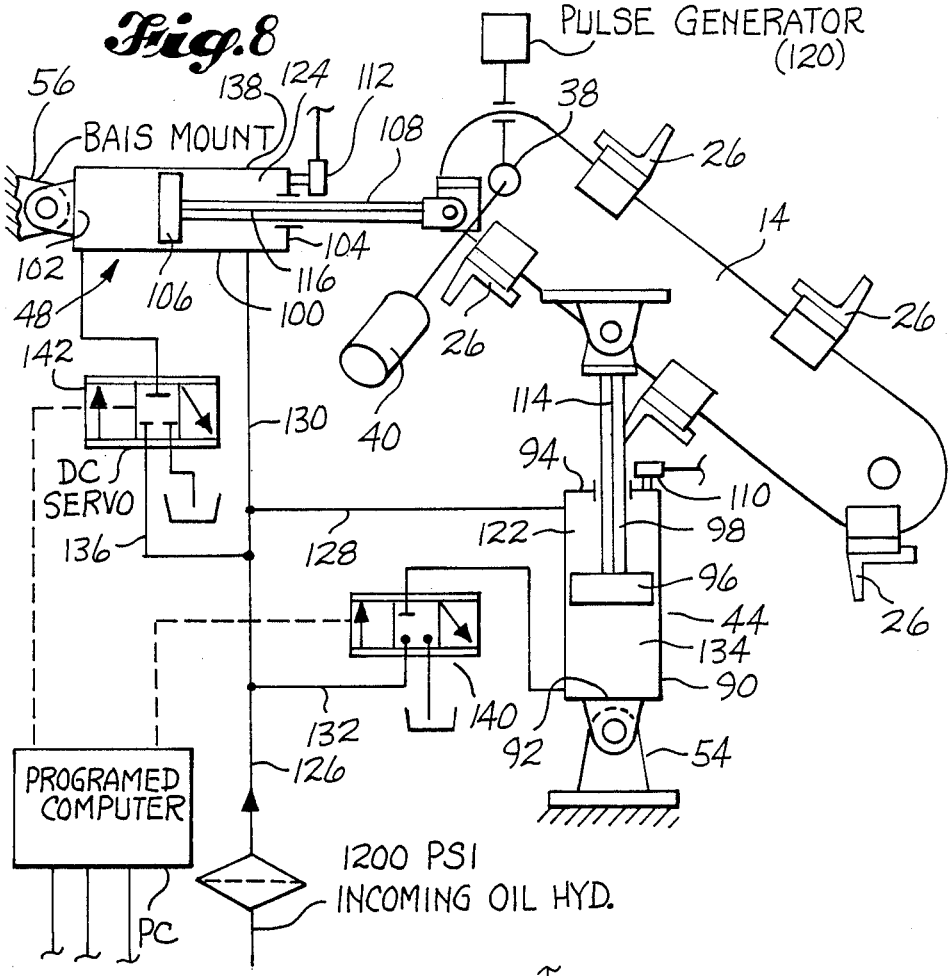
Figure 9:
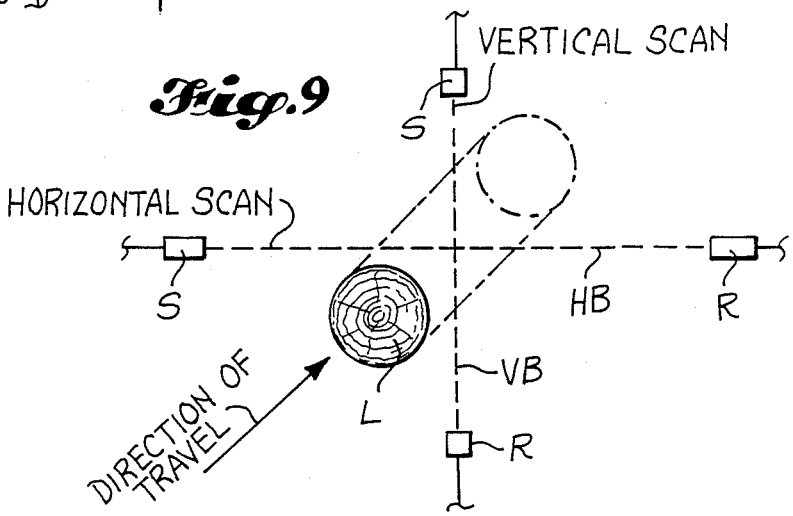
Figure 10:
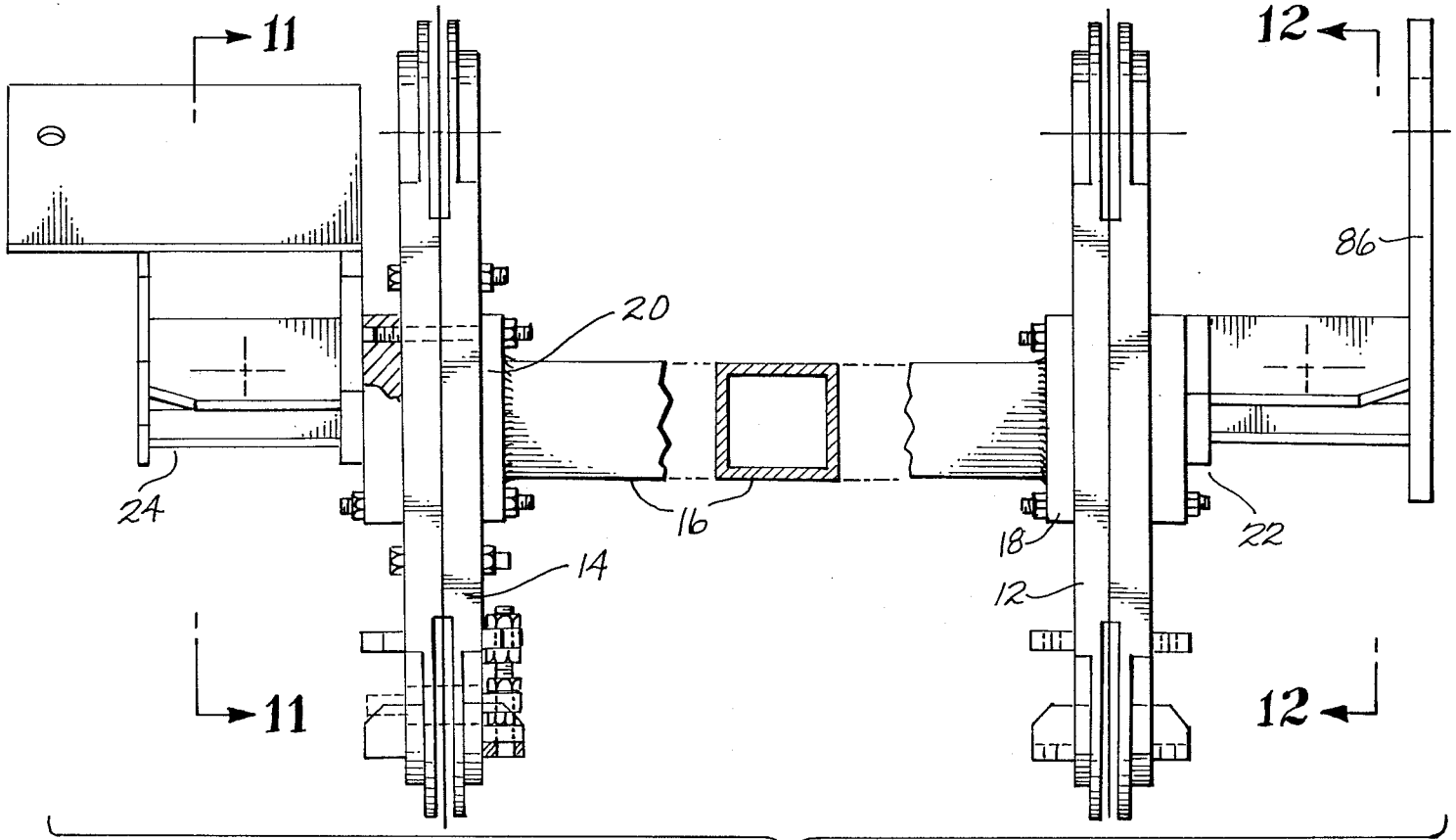
Figure 13:
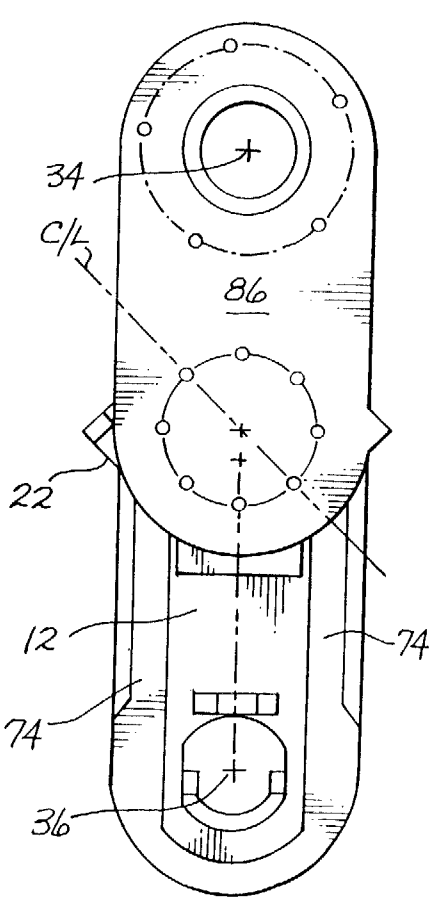
Figure 12:
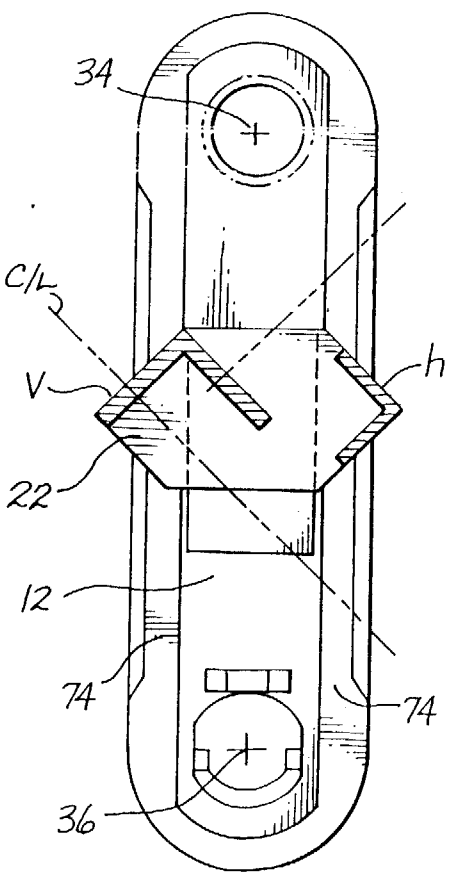
Figure 11:
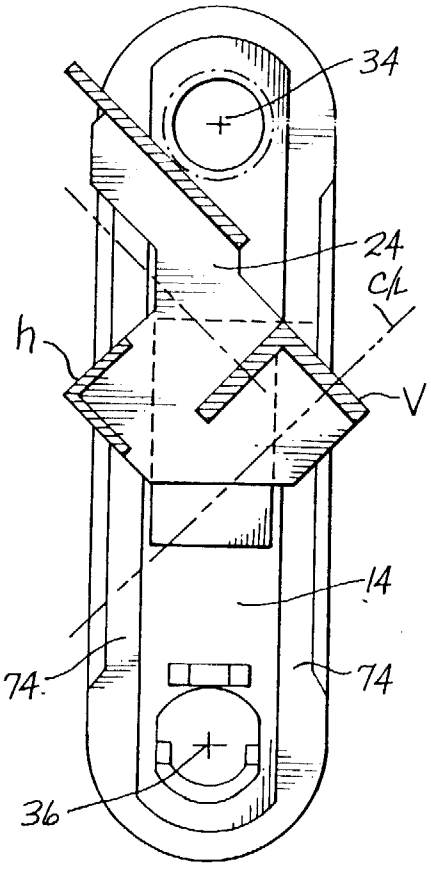
Figure 14:
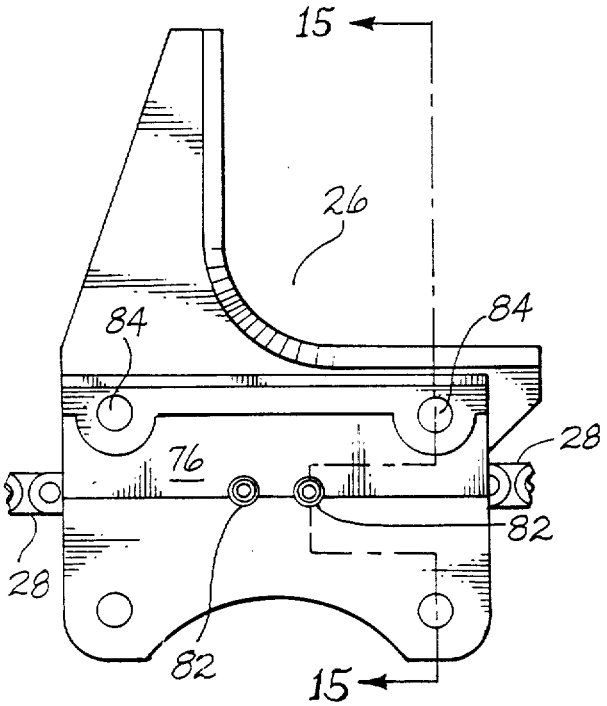
Figure 15:
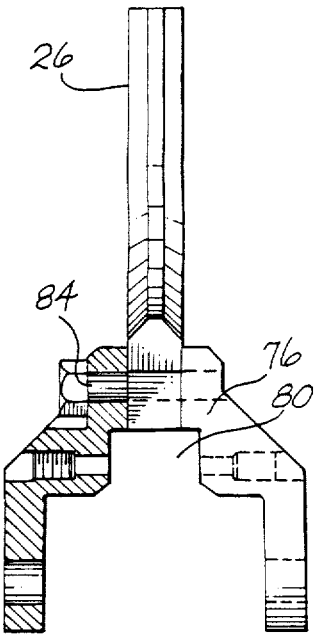
Figure 16:
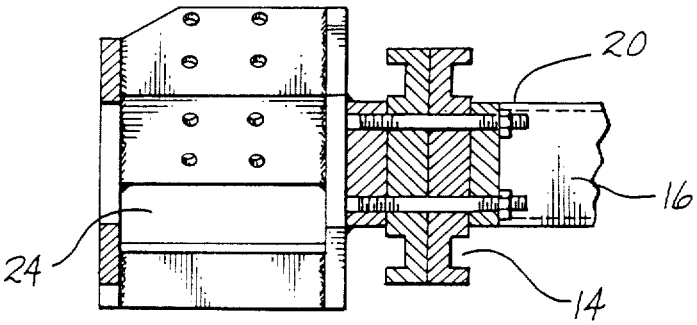

FIG. 6 us an enlarged scale, top plan view looking down at one end of the mechanism, showing a stabilizer bar at such end;

FIG. 7 is a cross-sectional view taken through a side portion of the conveyor substantially along line 7—7 of FIG. 4;

FIG. 8 is a schematic view of the control system for the log-feeding mechanism;

FIG. 9 is a diagram showing the path of travel of the logs through the light curtains which function to measure the horizontal and vertical diameters of the logs;

FIG. 10 is an elevational view of the conveyor frame, with the midportion of the center frame broken away, such view further showing the center frame in cross-section at the center of the view;

FIG. 11 is a sectional view taken substantially along like 11—11 of FIG. 10;

FIG. 12 is a sectional view taken substantially along ling 12—12 of FIG. 10;

FIG. 13 is an end elevational view of the conveyor frame, looking towards the end of the frame shown on the right in FIG. 10;

FIG. 14 is a side elevational view of one of the log-engaging lugs;

FIG. 15 is a view partially in section and partially in elevation, with the sectional portion being taken substantially along line 15—15 of FIG. 14; and FIG. 16 is a fragmentary view at one end of the conveyor frame, showing the end frame, and the lug-mounting frame at such end, bolted to an end portion of the center frame.

BEST MODE FOR CARRYING OUT THE INVENTION

Figure 1:
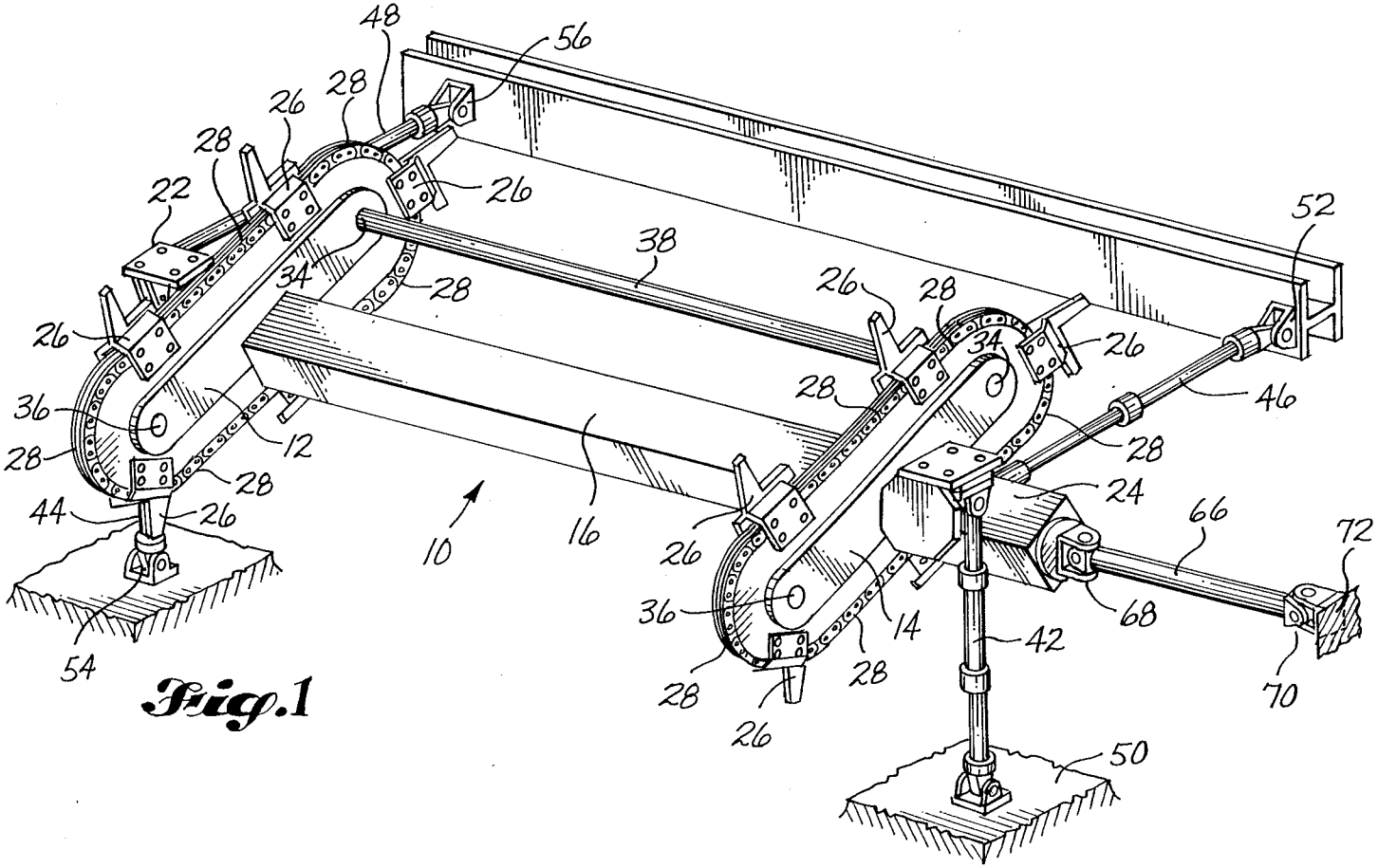
FIG. 1 is a pictorial view of a log-positioning mechansim constructed according to the present invention, taken from above and looking towards one end and the rear of the mechanism.
Figure 2:
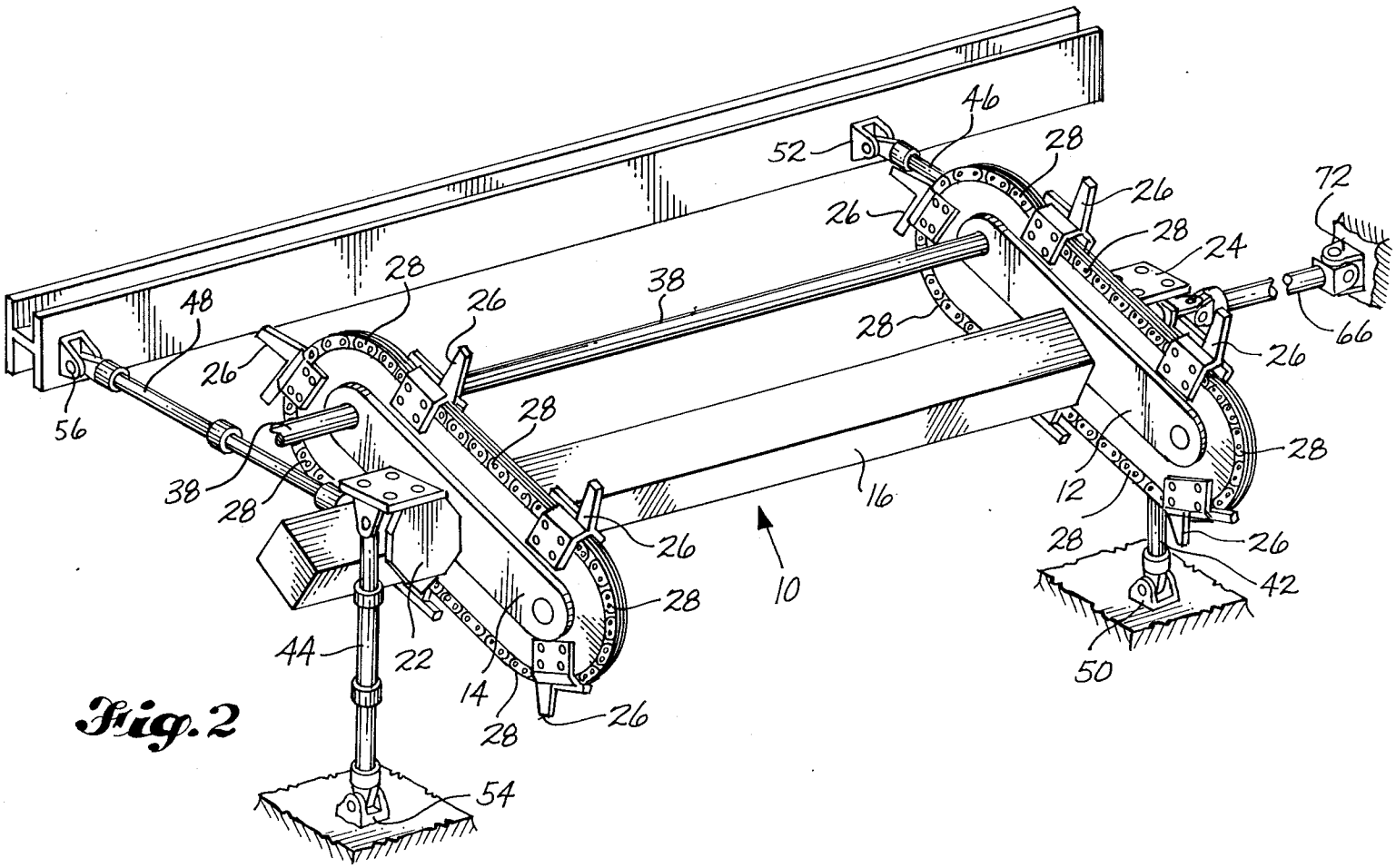
FIG. 2 is a view like FIG. 1, but looking towards the opposite end of the mechanism.

Referring now to FIGS. 1 and 2, the log-positioning mechanism 10 comrpises a frame which includes a pair of spaced-apart lug-supporting frame members 12, 14 and an interconnecting center frame 16. The center frame 16 may be a tubular member, as illustrated (FIG. 10), having flanged 18, 20 at its opposite ends. The flanges 18, 20 are bolted to the lug-supporting frame members 12, 14 (FIGS. 10 and 16). Center frame 16 rigidly interconnects the lug-supporting frame members 12, 14 so that each is substantially fixed in position relative to the other.

End frames 22, 24 are positioned outwardly of the lug-supporting frame members 12, 14, each substantially in alignment with the center frame 16. These end frames 22, 24 may be bolted to the outside of the lug-supporting frame members 12, 14 (see FIGS. 10 and 16). Each lug-supporting frame member 12, 14 supports and establishes an endless path of travel for a plurality of log-engaging lugs 26. The lugs 26 are connected together by chain sections 28 which ride on upper and lower sprockets 30, 32 having centers at 34, 36.

The lug-supporting frame members 12, 14, the log-engaging lugs 26, the chain sections 28 and the sprockets 30, 32 constitute components of an endless path conveyor. As shown by FIGS. 1–4, the endless path conveyor has an ascending upper run which may extend at a forty-five degree angle from horizontal. The conveyor also includes a drive shaft 38. Drive shaft 38 interconnects the two upper sprockets 30. One end of drive shaft 38 is connected to a stepper motor 40 (see FIG. 5) The stepper motor 40 serves to step the log-supporting lugs 26 in position around the endless conveyor path. Each time the drive stops, a first new pair of lugs 26 (one at each end of the log) is positioned at the lowermost or start position on the upper ruhn of the conveyor and a second new pair of lugs 26 is positioned at an uppermost position on the conveyor.

The conveyor is supported and positioned by a pair of vertical cylinders 42, 44, one at each end of the frame, and by a pair of horizontal cylinders 46, 48, one at each end of the frame. Cylinders 42 and 46 extend between end frame 24 and annchor points 50, 52. Cylinders 44, 48 are interconnected between end frame assembly 22 and anchor points 54, 56. The anchor points 50, 52, 54, 56 may be locations on a main frame, or may be otherwise provided. A standard spherical bearing connection is provided at each end of each cylinder 42, 44, 46, 48.

Figure 3:
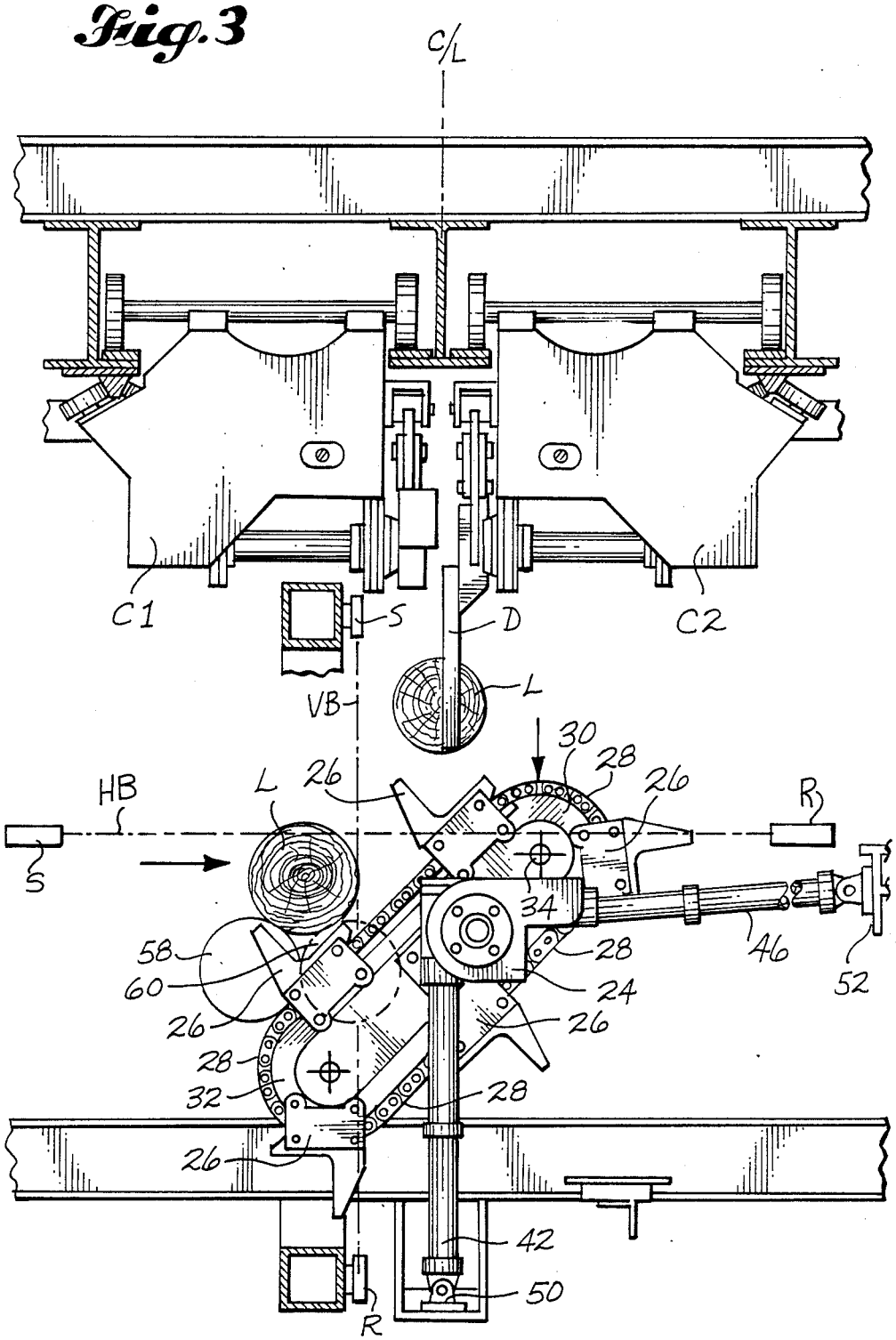
FIG. 3 is an end view of the log-positioning mechanism, showing such mechanism positioned below the centerline of a twin carriage machine, such view showing the conveyor lowered to place the log-engaging cradels of a pair of lugs at a start position below the wheels of a log-turning mechanism, and further showing another log engaged by one of the two end-dogging log carriages.
Figure 5:
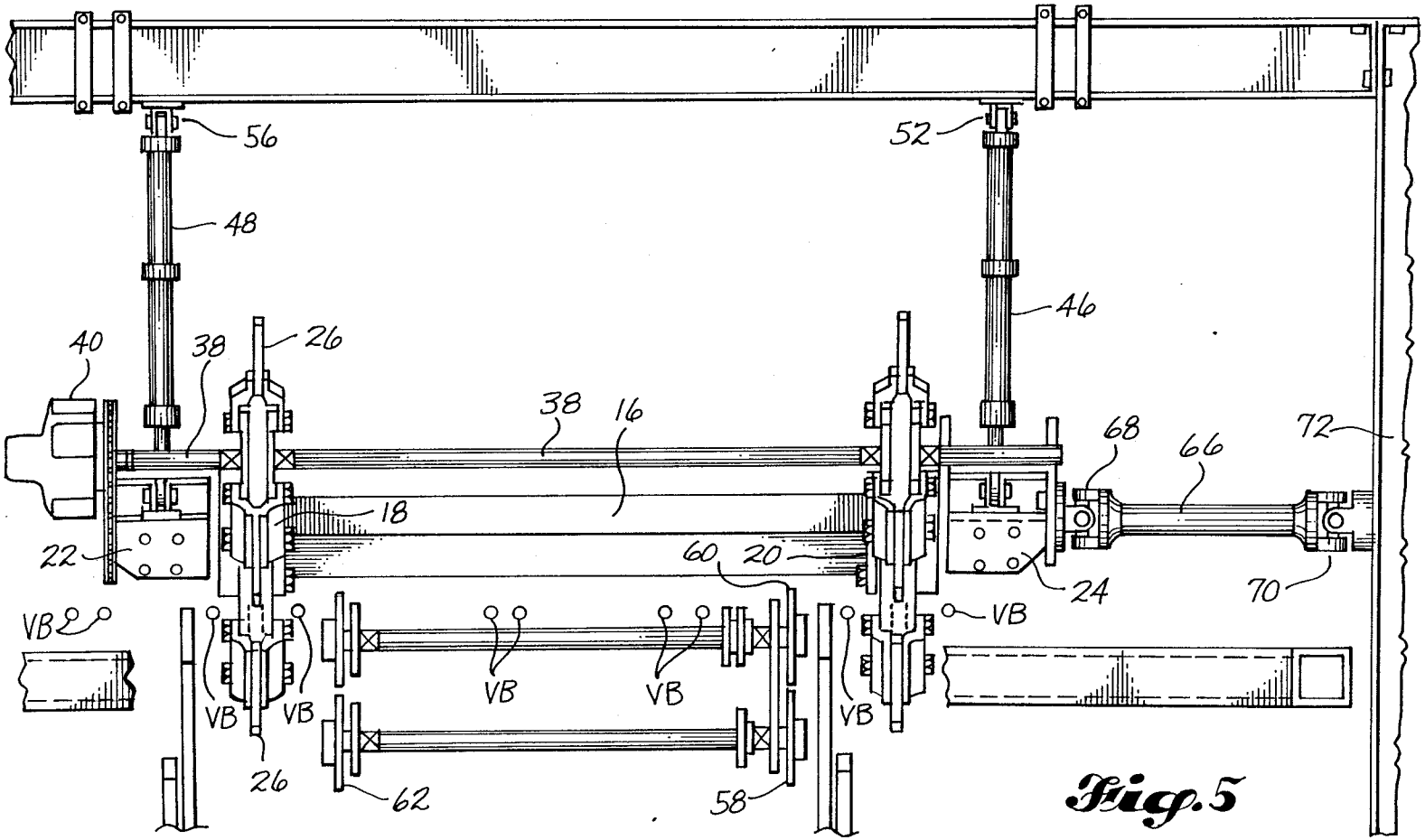
FIG. 5 is a plan view of the log delivery mechanism.

The conveyor is moved vertically up and down by the vertical cylinders 42, 44. The conveyor has a lowered position in which the log engaging lugs 26, as they start up the upper run, are spaced below the nips established by log-turning wheels 58, 60, 62, 64 (FIGS. 3 and 5). The conveyor is in this lowered position when a log L is deposited onto the wheels 58, 60, 62, 64 by a singulator (not shown) which is not a part of the invention. Then, the conveyor is lifted to move the "start" position lugs 26 upwardly into engagement with the log L. The vertical cylinders 42, 44 are extended until the start position lugs 26 pick up the log L off from the wheels 58, 60, 62, 64. Next, the stepping motor 40 is operated to step the log-supporting lugs 26, and the log L, upwardly to the uppermost position on the conveyor. As each log L moves upwardly, it also moves forwardly. As each log L moves, it is measured, in a manner to be hereinafter described, and a measurement signal is generated. After the measured log L and its lugs 26 have reached the uppermost position of the conveyor, the cylinders 42, 44, 48 are operated to move the conveyor in position vertically and/or horizontally. The amount and direction of movement is determined by the measurement signal. The conveyor and the log L are moved in an amount and direction necessary to place the ends of the log L into a particular desirable pick-up position for that particular log.

FIGS. 3 and 4 show the log positioning mechanism positioned to deliver logs L successively to a pick-up station for a twin carriage. The carriages C1, C2 pick up the logs L and move them relative to saw blades or chipper heads.

Each log carriage C1, C2 includes pair of spaced-apart end dogs designated D in FIGS. 3 and 4. Following positioning of the conveyor to, in turn, position a log L at the uppermost position on the conveyor, the end dogs D are swung downwardly into gripping engagement with the opposite ends of the log L. Then, the cylinders 42, 44, 46, 48 are retracted to move the conveyor to, in turn, move the lugs 26 down and away from contact with the log L. Then the carriage C1 or C2 is moved along its track, away from the positioning mechanism to and though the saws or chipper heads.

It is to be understood that the log-positioning mechanism of the invention is also usable for feeding logs to a single log carriage.

When a twin carriage system is utilized, a log L is being delivered to a first of the carriages (e.g. C1) while the second carriage (e.g. C2) is moving a log L that was previously delivered to it through the saws or chipper heads. While the second carriage (e.g. C2) is moving from the log-positioning mechanism to the saws or chippers, the first carriage (e.g. C1) is returning back to pick up another log L. The end dogs of the carriages C1, C2 are in an "up" position when the carriages C1, C2 are returning to the log-positioning mechanism to receive another log.

In a twin carriage system, the log-engaging dogs D for the two carriages C1, C2 are positioned in closely adjacent planes but there is always a slight amount of space between them. FIG. 3 shows an end dog D for the carriage C1 in a log-engaging position. FIG. 4 shows an end dog D for the carriage C2 in a log-engaging position. A comparison of these figures shows the end dogs D for carriage C1 to be on the left side of the machine centerline c/c and the end dogs D for carriage C2 to be on the right side of the centerline.

As is clearly shown by FIGS. 1 and 2, the conveyor 10 is only supported vertically by the two vertical cylinders 42, 44. The two horizontal cylinders 46, 48 provide some stabilization of the conveyor 10 is position relative to the anchor locations 52, 56. However, the cylinders 42, 44, 46, 48 provide no bracing of the conveyor against endwise movement. They also do not prevent rotational movement of the conveyor about the longitudinal axis of center frame 16 during extension and retraction of the cylinders. According to an aspect of the invention, the necessary stabilization is provided very simply. A non-rotating stabilizing shaft 66 (see FIG. 6) is positioned endwise of the conveyor frame. Shaft 66 includes a first universal joint 68 at its inner end which is connected to the conveyor end frame 24. A second universal joint 70 at the opposite or outer end of shaft 66 is secured to an anchor structure 72 which may be a beam of a main frame. As stated, shaft 66 does not rotate. The universal joints 68, 70 permit the shaft 66 to askew in position an amount sufficient to permit the horizontal and/or vertical movement of the conveyor which occurs during use of the delivery and positioning mechanism. However, shaft 66 and universal joints 68, 70 prevent rotation of the conveyor about the center beam 16. They also prevent endwise travel or "sway" of the conveyor on the vertical cylinders 42, 44. FIG. 5 shows horizontal cylinders 46, 48 positioned such that the stabilizing arm 66 is substantially perpendicular to cylinder 46. FIG. 6 shows cylinder 46 extended from the position of FIG. 5, so as to move its end of the conveyor away from anchor location 52. As this movement of the conveyor occurs, the stabilizing arm 66 moves into a horizontally askewed position. The universal joints 68, 70 are also capable of moving to permit a similar change in position in the vertical direction. The angular movement of the shaft 66, in the horizontal and/or vertical direction, by necessity, causes a slight amount of endwise movement of the conveyor. However, this movement is very slight and is controlled. The pivot joints at the opposite ends of the cylinders 42, 44, 46, 48 are constructed to permit the cylinders to move an angle slightly in response to the slight endwise movement of the conveyor.

As shown by FIGS. 10 and 16, each lug-supporting frame member 12, 14 is initially constructed into two halves which are then joined together. Roller tracks 74 are machined into the frame halves. The base 76 of each log-engaging lug 26 carries a pair of rollers 78. The rollers 78 are received within the channels 74 and serve to guide the lugs around the frame member. As shown by FIGS. 7 and 15, the end portions of the chain sections 28 are received within channels 80 which extend longitudinally of the lug base 76. Anchor pins 82 extend laterally through the lug base 76 and serve to detachably connect the chain ends to the lug base 76. As shown by FIGS. 14 and 15, the log-engaging lugs 26 may be removably secured to the lug base 76, by means of securement pins 84, e.g. a nut and bolt assembly.

FIG. 5 shows the stepping motor 40 mounted onto a motor mount plate 86 which is a part of end frame 22 (FIGS. 10 and 13). The frame end of shaft 6 (i.e. universal joint 68) may, if desired, be secured to end frame 22, at the center of plate 86. The machine centerline is indicated in FIGS. 11–13 by a line marked "C/L". If each of these figures is disposed with the line in a vertical position, the correct disposition of the frame members 12, 14 will be established. In preferred form, the end frame members 12, 14 extend at a 45° angle from the horizontal, so that the ascending run of the conveyor is along a 45° grade. FIGS. 11 and 12 show the members to which the conveyor ends of the horizontal and vertical cylinders 42, 44, 46, 48 are attached. The ends of the vertical cylinders are attached to the member marked "v". The ends of the horizontal cylinders are attached to the member marked "h".

Referring to FIGS. 3, 4 and 9, according to an aspect of the invention, each log L is moved by the conveyor along an ascending 45° path (FIG. 9). As each log L moves, it must pass through a horizontal curtain of light beams HB and also through a vertical curtain of light beams VB. Each beam includes a sender S and a receiver R in axial alignment. Each of these components is connected to a programmed computer PC (FIG. 8). Referring to FIG. 9, each log L is initially below the horizontal curtain and to the left of the vertical curtain. As the log moves along the 45° path, its upper portion will eventually break the horizontal beams HB and its forward edge will eventually break the vertical beam VB. These beams will stay broken until the lower portion of the log clears the horizontal beams HB and the rear portion of the log L clears the vertical beams VB. The period of interruption of the vertical beams VB indicates the horizontal width of the log L. The period of interruption of the horizontal beams HB indicates the vertical width of the log L. In preferred form, a plurality of the horizontal senders and receivers (S and R) and a plurality of the vertical senders and receivers (S and R) are spaced apart horizontally to form the horizontal and vertical curtains of beams HB and VB.

Referring to FIG. 5, typical locations of the vertical beams VB are indicated. Note, in this view, there are ten vertical beams VB, for example. They are spaced apart such that each clears the machinery. A like number of horizontal beams HB are provided and they are also spaced apart so that they clear the machinery. As will be appreciated, the presence of a plurality of horizontal beams HB and a plurality of vertical beams VB makes it possible to fairly accurately measure the shape of the log L along its length, as well as its horizontal and vertical widths at the locations of the beams HB and VB. All of this information may be utilized by the computer PC for controlling the cylinders 42, 44, 46, 48 to, in turn, position the log delivery and positioning conveyor. The computer PC may be programmed to compute an average diameter for the log and use this information for placement of the log relative to the pick-up dogs D. In such case, it may be desirable to move the opposite ends of the conveyor equal amounts in both the horizontal and vertical directions. Or, the information may be used for moving one end of the conveyor a different amount than the opposite end.

Referring to FIG. 8, vertical cylinder 44 and horizontal cylinder 48 are shown somewhat schematically in cross section. Cylinder 44 includes a cylinder barrel 90 having a closed end 92 and a piston rod end 94. A piston head 96 is mounted to move within the cylinder barrel 90 betweenn the ends 92, 94. A piston rod 98 extends from piston head 96 out through the piston end 94. In similar fashion, cylinder 48 comprises a cylinder barrel 100 having a closed end 102 and a piston rod end 104. A piston head 106 reciprocates within cylinder barrel 100. A piston rod 108 extends from piston head 106 out through the piston rod end 104. Each cylinder 44, 48 (as well as cylinders 42, 46) includes a device for always sensing the exact position of the piston rod 98, 108 within the cylinder barrel 90, 100. This device is known per se and is shown in the form of a sensor 110, 112, mounted on the cylinder barrel 90, 100 and a core 114, 116 which extends lengthwise of the piston rod 98, 108. The combination of the sensor 100, 112 and the coe 114, 116 produces a signal dependent on the positioning of the piston 96, 98 and 106, 108 relative to the cylinder barrel 90, 100.

In use, the measurement information obtained by the senders and receivers (S and R) of the light beam scanners furnishes information to the computer PC which the computer uses for determining the amount and direction of movement of the four cylinders 42, 44, 46, 48 that is necessary to move the measured log L, after it reaches the uppermost position on the conveyor, into a desired pick-up position of that particular log relative to the pick-up dogs D of the carriage C1, C2 that will be receiving the log L. The sensors 100, 114 and 112, 116 inform the computer PC when the cylinders 40, 48 have moved the necessary distance. A pulse generator 120, or similar device, is associated with the drive shaft 38 for the conveyor, or with the stepper motor 40. It develops a signal which tells the computer PC of the exact position of the shaft 38 at all times. This information, in turn, tells that computer PC where each lug 26 is at all times. This information is used for controlling the motor 40 such that the lug pairs are 26 stopped at the proper position atop the conveyor.

As shown by FIG. 8, the rod end chambers 122, 124 of the cylinders 44, 46 are always connected to hydraulic pressure via lines 126, 128, 130. The same is true with cylinders 42, 46. A line 132 connects pressure line 126 with the base end chamber 134 of cylinder 44. A line 136 connects pressure line 126 with the base end chamber 138 of cylinder 48. Line 132 includes a three-position valve 140. An identical three-position valve 142 is located within line 136. Each valve 140, 142 has a center position in which flow through its line 132, 136 is blocked. Each is also shiftable sideways into position which communicates the pressure line 126 with its base end chamber 134, 138. Each valve 140, 142 is shiftable endwise in the opposite direction into a position wherein its base chamber 134, 138 is vented to return. Typically, the valves 140, 142 may be servo valves and include a DC coil controlled flapper which controls hydraulic pressure to the opposite ends of a valve spool, for shifting the valve spool one way or another from the neutral position, or holding it in the neutral position. The computer PC sends an electrical signal to the DC motor which controls the flapper. As stated above, pressure is always communicated to the rod end chamber of each cylinder. Despite this, the rod will not move relative to the cylinder barrel when the control valve is closed. When the control valve is moved so as to vent the base end chamber, the pressure within the rod end chamber will cause the piston to retract. It will retract until the valve is again closed. Then, the piston will stop. When the valve is moved to communicate pressure to the base end of the cylinder, the cylinder will extend. This is because the base end of the piston head has a larger area than the rod end of the piston head. The pressure acting on the area differential produces the force which extends the piston. Extension will continue until the valve is again closed. At that time, the piston will stop.

It is to be understood that the illustrated embodiment is presented as an example of the invention. The coverage is not to be limited by such example, but only by the appended claims, interpreted in accordance with established rules of patent claim interpretation, including the use of the doctrine of equivalents.

What is claimed is:

1. A log delivery and positioning mechanism, comprising:

an endless conveyor having an endless conveyor path including an ascending upper run, a plurality of spaced-apart log-engaging lugs which travel the endless conveyor path, and a power drive for stepping the lugs in position about the endless conveyor path, with each step positioning a new log-engaging lug in an uppermost position on the conveyor, wherein in use logs are delivered in succession onto the upper run, each immediately forwardly of a log-engaging lug, and the log-engaging lugs engage the logs and move them forwardly and upwardly as the log engaging-lugs move;

measurement means for measuring at least a diameter of each log as it travels along the upper run of the conveyor, prior to such log reaching said uppermost position on the conveyor, and producing a measurement signal; and positioning means responsive to the measurement signal for moving the conveyor horizontally and/or vertically as necessary after the measured log reaches said uppermost position on the conveyor, to move such log into a desirable pick-up position for that particular log.

2. A log delivery and positioning mechanism according to claim 1, wherein the measurement means includes optical means for measuring both the horizontal and vertical diameters of each log.

3. A log delivery and positioning mechanism according to claim 2, wherein the optical means comprises means establishing horizontal and vertical scanning beams through which each log must pass as it moves along the upper run of the conveyor to the uppermost position on the conveyor.

4. A log delivery and positioning mechanism according to claim 3, wherein the optical means includes a plurality of horizontally spaced-apart means for producing a plurality of spaced-apart vertical light beams and a plurality of horizontally spaced-apart means for producing a plurality of spaced-apart horizontal light beams, wherein in use log diameter information is generated by each ascending log as it passes through said light beams.

5. A log delivery and positioning mechanism according to claim 1, wherein the positioning means comprises horizontal and vertical cylinders interconnected between the conveyor and a support structure and control means responsive to the measurement signal for each log for extending or retracting the cylinders to move the conveyor horizontally and/or vertically position the particular log that is at the uppermost position of the conveyor.

6. A log delivery and positioning mechanism according to claim 5, wherein the conveyor comprises a frame including a pair of spaced-apart lug supporting frame members and a center frame extending between and rigidly interconnecting said frame members so that each said frame member is substantially fixed in position relative to the other frame member, and wherein said horizontal and vertical cylinders have end portions connected to opposite end portions of the conveyor frame.

7. A log delivery and positioning mechanism according to claim 6, wherein said power drive includes a rotary drive shaft extending horizontally between said lug-supporting frame members, said drive shaft having a sprocket wheel at each end, each said lug-supporting frame member including drive chain means interconnecting its lugs and engaging a said sprocket wheel, and a stepping motor connected to said shaft for rotating the shaft to in turn rotate the sprocket wheels and drive the drive chains, to step the lugs in position along the conveyor path.

8. A log delivery and positioning mechanism according to claim 6, comprising stabilizing means positioned at one end of the conveyor frame, for bracing the endless conveyor against sway movement on the cylinders, in a direction endwise of the frame, and for holding the conveyor frame in position to prevent a rotational movement of the conveyor frame about an axis extending longitudinally of the conveyor frame, a said cylinders extend and retract to position the conveyor.

9. A log delivery and positioning mechanism according to claim 8, wherein said stabilizing means comprises a non-rotating shaft having a universal joint at each end, with the universal joint at a first end being connected to the conveyor frame and the universal joint at the second end being connected to a fixed support structure.

10. A log delivery and positioning mechanism according to claim 5, wherein the measurement means includes optical means for measuring both the horizontal and vertical diameters of each log.

11. A log delivery and positioning mechanism according to claim 6, wherein the optical means comprises means establishing horizontal and vertical scanning beams through which each log must pass as it moves along the upper run of the conveyor to the uppermost position on the conveyor.

12. A log delivery and positioning mechanism according to claim 11, wherein the optical means includes a plurality of horizontally spaced-apart means for producing a plurality of spaced-apart vertical light beams and a plurality of horizontally spaced-apart means for producing a plurality of spaced-apart horizontal light beams, wherein in use log diameter information is generated by each ascending log as it passes through said light beams.

13. A log delivery and positioning mechanism comprising an endless conveyor comprising a frame including a pair of spaced-apart lug-supporting frame members and a center frame rigidly interconnection said frame members so that each said frame member is substantially fixed in position relative to the other frame member;

a plurality of spaced-apart log-engaging lugs supported on each lug-supporting frame member, for travel around an endless conveyor path which includes an ascending upper run;

a power drive for stepping the lugs in position about the endless conveyor lug, with each step positioning a new log-engaging lug in an uppermost position on its lug-supporting frame member, where in use logs are delivered in succession onto the upper run, each immediately forwardly of a log-engaging lug on each said lug-supporting frame member, and the log-engaging lugs engage the logs and move them forwardly and upwardly as the log-engaging lugs move;

positioning means for the conveyor comprising a horizontal and a vertical hydraulic cylinder at each end of the conveyor frame, said horizontal and vertical cylinders being interconnected between the conveyor frame and a support structure, said vertical cylinders being extendible and retractable to raise and lower the conveyor, and said horizontal cylinders being extendible and retractable to move the conveyor in position horizontally.

14. A log delivery and positioning mechanism according to claim 13, wherein said power drive includes a rotary drive shaft extending horizontally between said log-supporting frame members, said drive shaft having a sprocket wheel at each end, each said lug-supporting frame member including drive chain means interconnecting its lugs and engaging a sprocket wheel, and a stepping motor connected to said shaft for rotating the shaft to in turn rotate the sprocket wheels and drive the drive chain, to in that manner step the lugs in position along the conveyor path.

15. A log delivery and positioning mechanism according to cliam 13, comprising stabilizing means positioned at each end of the conveyor frame, for bracing the endless conveyor against sway movement on the vertical cylinders, in a direction endwise of the frame, and for holding the conveyor frame in position to prevent a rotational movement of the conveyor frame about an axis extending longitudinally of the conveyor frame as said cylinders extend and retract to position the conveyor.

16. A log delivery and positioning mechanism according to claim 15, wherein said stabilizing means comprises a non-rotating shaft having a universal joint at each end, with the universal joint at a first end being connected to the conveyor frame and the universal joint at the second end being connected to a fixed support structure.

* * * * *

UNITED STATES PATENT AND TRADEMARK OFFICE

CERTIFICATE OF CORRECTION

PATENT NO. : 4,949,769

DATED : August 21, 1990

INVENTOR(S) : Robert E. Cameron

It is certified that error appears in the above-identified patent and that said Letters Patent is hereby corrected as shown below:

Col. 1, line 46, "endles" should be -- endless --.

Col. 3, line 42, "cradels" should be -- cradles --.

Col. 4, line 17, "comrpises" should be -- comprises --.

Col. 4, line 21, "flanged" should be -- flanges --.

Col. 4, line 50, "ruhn" should be -- run --.

Col. 4, line 57, "annchor" should be -- anchor --.

Col. 4, lines 58 and 59, "assembly 22" should be -- assembly 2 --.

UNITED STATES PATENT AND TRADEMARK OFFICE

CERTIFICATE OF CORRECTION

PATENT NO. : 4,949,769

DATED : August 21, 1990

INVENTOR(S) : Robert E. Cameron

It is certified that error appears in the above-identified patent and that said Letters Patent is hereby corrected as shown below:

The sheets of drawings consisting of"sheet 1 of 8" should read -- Sheet 1 of 10--.

Figures 11 - 16 should be added as shown on the attached page.

Signed and Sealed this

Twenty-sixth Day of May, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,949,769

DATED : August 21, 1990

INVENTOR(S) : Robert E. Cameron

It is certified that error appears in the above-identified patent and that said Letters Patent is hereby corrected as shown below:

Col. 1, line 46, "endles" should be -- endless --.

Col. 3, line 42, "cradels" should be -- cradles --.

Col. 4, line 17, "comrpises" should be -- comprises --.

Col. 4, line 21, "flanged" should be -- flanges --.

Col. 4, line 50, "fuhn" should be -- run --.

Col. 4, line 57, "annchor" should be -- anchor --.

Col. 4, lines 58 and 59, "assembly 22" should be -- assembly 2 --.

UNITED STATES PATENT AND TRADEMARK OFFICE

CERTIFICATE OF CORRECTION

PATENT NO. : 4,949,769

DATED : August 21, 1990

INVENTOR(S) : Robert E. Cameron

It is certified that error appears in the above-identified patent and that said Letters Patent is hereby corrected as shown below:

Col. 5, line 28, after "includes", insert -- a --.

Col. 5, line 66, "is" should be -- in --.

Col. 6, line 6, delete "(see Fig. 6)".

Col. 6, line 32, "direction" should be -- directions --.

Col. 6, line 56, "shaft 6" should be -- shaft 66 --.

Col. 7, line 15, "beam" should be -- beams --.

Col. 7, line 54, "betweenn" should be -- between --.

Col. 7, line 67, "coe" should be -- core --.

Col. 8, line 33, after "into", insert -- a --.

Claim 5, col. 9, line 49, after "vertically", insert -- to -

Claim 8, col. 10, line 12, "a" should be -- as --.

Claim 15, col. 11, line 13, "cliam" should be -- claim --.

Signed and Sealed this

Ninth Day of June, 1992

*Attest:*

DOUGLAS B. COMER

*Attesting Officer*

*Acting Commissioner of Patents and Trademarks*